US012509958B2

(12) United States Patent
Holderman et al.

(10) Patent No.: US 12,509,958 B2
(45) Date of Patent: Dec. 30, 2025

(54) EXPANDABLE METAL SLIP RING FOR USE WITH A SEALING ASSEMBLY

(71) Applicant: Halliburton Energy Services, Inc., Houston, TX (US)

(72) Inventors: Luke William Holderman, Houston, TX (US); Shanu Thottungal Eldho, Houston, TX (US); Stephen Michael Greci, Carrollton, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 17/325,754

(22) Filed: May 20, 2021

(65) Prior Publication Data

US 2022/0372837 A1 Nov. 24, 2022

(51) Int. Cl.
*E21B 33/129* (2006.01)

(52) U.S. Cl.
CPC ..... *E21B 33/1292* (2013.01)

(58) Field of Classification Search
CPC ..... E21B 33/1292
See application file for complete search history.

(56) References Cited

U.S. PATENT DOCUMENTS 3,371,716 A * 3/1968 Current ..... E21B 33/1216 166/134
5,492,173 A * 2/1996 Kilgore ..... E21B 41/00 166/66.4
2002/0088616 A1 7/2002 Swor et al.
2004/0026079 A1* 2/2004 Johnson ..... E21B 43/108 166/227
2013/0192853 A1* 8/2013 Themig ..... E21B 33/128 166/134
2016/0326830 A1* 11/2016 Hallundbæk ..... E21B 43/103
2017/0234103 A1* 8/2017 Frazier ..... E21B 43/26 166/138
2018/0023366 A1 1/2018 Deng et al.
(Continued)

FOREIGN PATENT DOCUMENTS

CN 205422632 U 8/2016
WO 2015080751 A1 6/2015
(Continued)

*Primary Examiner* — Tara Schimpf

(74) *Attorney, Agent, or Firm* — Scott Richardson; Parker Justiss, P.C.

(57) ABSTRACT

Provided is a slip ring for use with a sealing assembly, a sealing tool, and a method for sealing an annulus within a wellbore. The slip ring, in at least one aspect, includes an expandable metal ring member having a width (w), a wall thickness (t), an inside diameter ($d_i$) and an outside diameter ($d_o$), the expandable metal ring member comprising a metal configured to expand in response to hydrolysis. The slip ring, in at least one aspect, further includes one or more cuts located in the wall thickness (t) and spaced around a circumference of the expandable metal ring member, the one or more cuts configured to allow the expandable metal ring member to move between a radially reduced state and a radially enlarged state.

14 Claims, 7 Drawing Sheets

(56) References Cited

U.S. PATENT DOCUMENTS

| | | | | |
|---|---|---|---|---|
| 2018/0038193 | A1 | 2/2018 | Walton et al. | |
| 2019/0078414 | A1* | 3/2019 | Frazier | E21B 33/129 |
| 2020/0080401 | A1 | 3/2020 | Sherman | |
| 2020/0370391 | A1* | 11/2020 | Fripp | E21B 33/1212 |
| 2021/0123310 | A1 | 4/2021 | Fripp et al. | |
| 2021/0189817 | A1* | 6/2021 | Fripp | E21B 33/1208 |
| 2021/0270093 | A1* | 9/2021 | Fripp | E21B 17/1078 |

FOREIGN PATENT DOCUMENTS

| | | | | |
|---|---|---|---|---|
| WO | WO-2020167288 | A1 * | 8/2020 | E21B 33/1208 |
| WO | 2021034325 | A1 | 2/2021 | |
| WO | 2021086317 | A1 | 5/2021 | |

* cited by examiner

EXPANDABLE METAL SLIP RING FOR USE WITH A SEALING ASSEMBLY

BACKGROUND

A typical sealing assembly (e.g., packer, bridge plug, etc.) generally has one or more sealing elements or "rubbers" that are employed to provide a fluid-tight seal radially between a mandrel of the sealing assembly and the casing or wellbore into which the sealing assembly is disposed. Such a sealing assembly is commonly conveyed into a subterranean wellbore suspended from tubing extending to the earth's surface.

To prevent damage to the seal elements while the sealing assembly is being conveyed into the wellbore, the seal elements are carried on the mandrel in a relaxed or uncompressed state in which they are radially inwardly spaced apart from the casing. When the sealing assembly is set, the seal elements radially expand (e.g., both radially inward and radially outward), thereby sealing against the mandrel and the casing and/or wellbore. In certain embodiments, the seal elements are axially compressed between element retainers straddling the seal elements on the seal assembly, which in turn radially expand the seal elements. In other embodiments, one or more swellable seal elements are axially positioned between the element retainers, the swellable seal elements configured to radially expand when subjected to one or more different activation fluids.

The seal assembly often includes one or more slip rings which grip the casing and prevent movement of the seal assembly axially within the casing after the sealing elements have been set. Thus, if weight or fluid pressure is applied to the seal assembly, the slip rings resist the axial forces on the seal assembly produced thereby, and prevent axial displacement of the seal assembly relative to the casing and/or wellbore.

BRIEF DESCRIPTION

Reference is now made to the following descriptions taken in conjunction with the accompanying drawings, in which.

DETAILED DESCRIPTION

Figure 1:
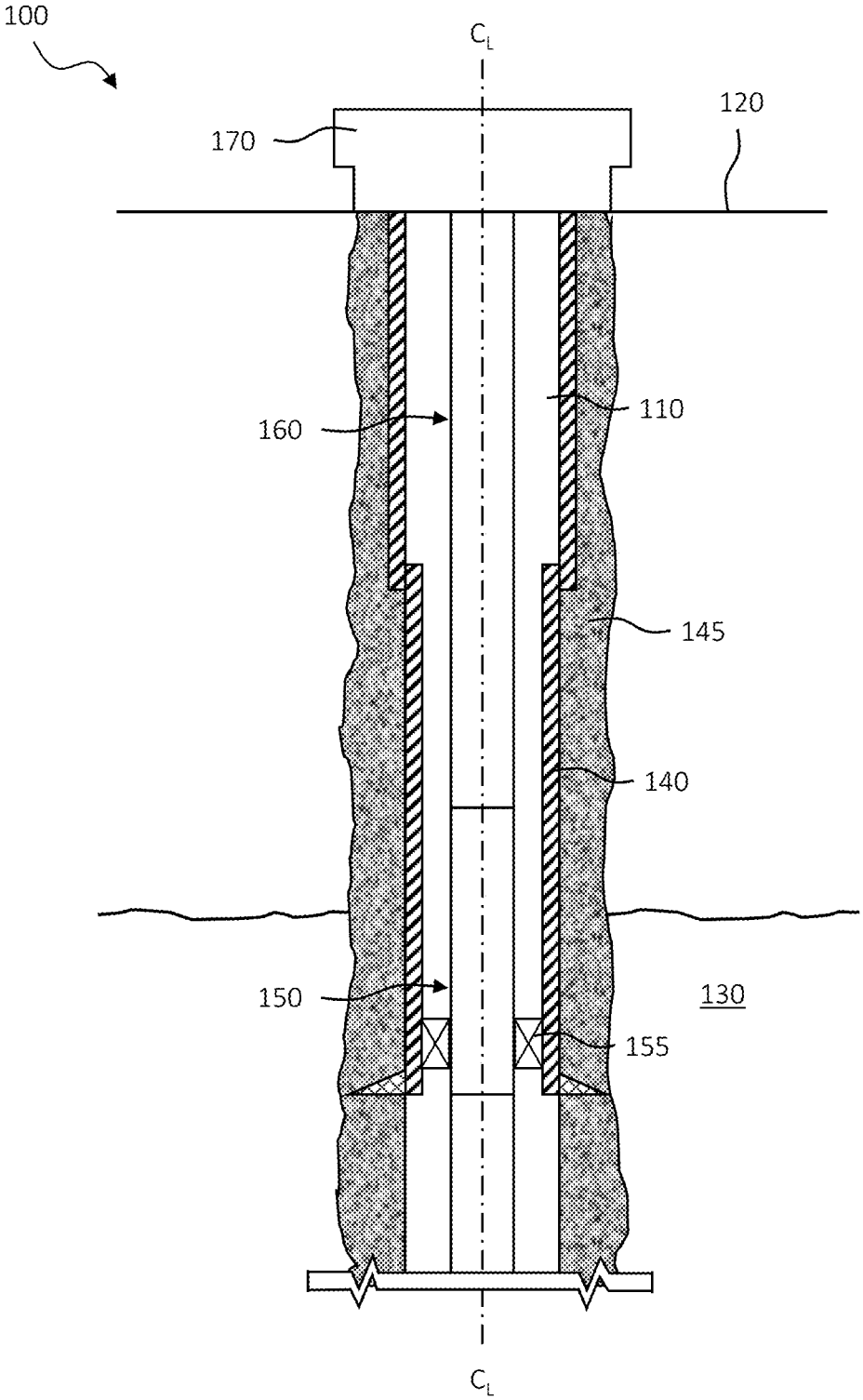
FIG. 1 illustrates a well system designed, manufactured, and operated according to one or more embodiments of the disclosure, the well system including a sealing tool including a sealing assembly designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The present disclosure describes a slip ring employing expandable/expanded metal as an anchor in a sealing assembly of a sealing tool (e.g., a compression set packer or in a swell rubber packer). The expandable/expanded metal may embody many different locations, sizes and shapes within the seal assembly while remaining within the scope of the present disclosure. In at least one embodiment, the expandable/expanded metal reacts with fluids within the wellbore to create a sturdy sealing tool anchor. Accordingly, the use of the expandable/expanded metal within the slip ring minimizes the likelihood of the sealing tool axially slipping.

FIG. 1 illustrates a well system 100 designed, manufactured, and operated according to one or more embodiments of the disclosure, the well system 100 including a sealing tool 150 including a sealing assembly 155 designed, manufactured and operated according to one or more embodiments of the disclosure. The well system 100 includes a wellbore 110 that extends from a terranean surface 120 into one or more subterranean zones 130. When completed, the well system 100 produces reservoir fluids and/or injects fluids into the subterranean zones 130. As those skilled in the art appreciate, the wellbore 120 may be fully cased, partially cased, or an open hole wellbore. In the illustrated embodiment of FIG. 1, the wellbore 110 is at least partially cased, and thus is lined with casing or liner 140. The casing or liner 140, as is depicted, may be held into place by cement 145.

An example well sealing tool 150 is coupled with a tubing string 160 that extends from a wellhead 170 into the wellbore 110. The tubing string 160 can be a coiled tubing and/or a string of joint tubing coupled end to end. For example, the tubing string 160 may be a working string, an injection string, and/or a production string. The sealing tool 150 can include a bridge plug, frac plug, packer and/or other sealing tool, having a seal assembly 155 for sealing against the wellbore 110 wall (e.g., the casing 140, a liner and/or the bare rock in an open hole context). The seal assembly 155 can isolate an interval of the wellbore 110 above the seal assembly 155 from an interval of the wellbore 110 below the seal assembly 155, for example, so that a pressure differential can exist between the intervals.

In accordance with the disclosure, the seal assembly 155 may include a slip ring including an expandable metal ring member having a width (w), a wall thickness (t), an inside diameter ($d_i$) and an outside diameter ($d_o$), the expandable metal ring member comprising a metal configured to expand in response to hydrolysis. The term expandable metal, as used herein, refers to the expandable metal in a pre-expansion form. Similarly, the term expanded metal, as used herein, refers to the resulting expanded metal after the expandable metal has been subjected to reactive fluid, as discussed below. The expanded metal, in accordance with one or more aspects of the disclosure, comprises a metal that has expanded in response to hydrolysis. In certain embodiments, the expanded metal includes residual unreacted metal. For example, in certain embodiments the expanded metal is intentionally designed to include the residual unreacted metal. The residual unreacted metal has the benefit of allowing the expanded metal to self-heal if cracks or other anomalies subsequently arise, or for example to accommodate changes in the tubular or mandrel diameter due to variations in temperature and/or pressure. Nevertheless, other embodiments may exist wherein no residual unreacted metal exists in the expanded metal.

The expandable metal, in some embodiments, may be described as expanding to a cement like material. In other words, the expandable metal goes from metal to micron-scale particles and then these particles expand and lock together to, in essence, assist in preventing extrusion within the sealing assembly. The reaction may, in certain embodiments, occur in less than 2 days in a reactive fluid and in downhole temperatures. Nevertheless, the time of reaction may vary depending on the reactive fluid, the expandable metal used, and the downhole temperature.

In some embodiments, the reactive fluid may be a brine solution such as may be produced during well completion activities, and in other embodiments, the reactive fluid may be one of the additional solutions discussed herein. The expandable metal is electrically conductive in certain embodiments. The expandable metal may be machined to any specific size/shape, extruded, formed, cast or other conventional ways to get the desired shape of a metal, as will be discussed in greater detail below. The expandable metal, in certain embodiments has a yield strength greater than about 8,000 psi, e.g., 8,000 psi+/−50%.

The hydrolysis of the expandable metal can create a metal hydroxide. The formative properties of alkaline earth metals (Mg—Magnesium, Ca—Calcium, etc.) and transition metals (Zn—Zinc, Al—Aluminum, etc.) under hydrolysis reactions demonstrate structural characteristics that are favorable for use with the present disclosure. Hydration results in an increase in size from the hydration reaction and results in a metal hydroxide that can precipitate from the fluid.

The hydration reactions for magnesium is:

$$Mg+2H_2O \rightarrow Mg(OH)_2+H_2,$$

where $Mg(OH)_2$ is also known as brucite. Another hydration reaction uses aluminum hydrolysis. The reaction forms a material known as Gibbsite, bayerite, and norstrandite, depending on form. The hydration reaction for aluminum is:

$$Al+3H_2O \rightarrow Al(OH)_3+3/2H_2.$$

Another hydration reaction uses calcium hydrolysis. The hydration reaction for calcium is:

$$Ca+2H_2O \rightarrow Ca(OH)_2+H_2,$$

Where $Ca(OH)_2$ is known as portlandite and is a common hydrolysis product of Portland cement. Magnesium hydroxide and calcium hydroxide are considered to be relatively insoluble in water. Aluminum hydroxide can be considered an amphoteric hydroxide, which has solubility in strong acids or in strong bases. Alkaline earth metals (e.g., Mg, CA, etc.) work well for the expandable metal, but transition metals (Al, etc.) also work well for the expandable metal. In one embodiment, the metal hydroxide is dehydrated by the swell pressure to form a metal oxide.

In an embodiment, the expandable metal used can be a metal alloy. The expandable metal alloy can be an alloy of the base expandable metal with other elements in order to either adjust the strength of the expandable metal alloy, to adjust the reaction time of the expandable metal alloy, or to adjust the strength of the resulting metal hydroxide byproduct, among other adjustments. The expandable metal alloy can be alloyed with elements that enhance the strength of the metal such as, but not limited to, Al—Aluminum, Zn—Zinc, Mn—Manganese, Zr—Zirconium, Y—Yttrium, Nd—Neodymium, Gd—Gadolinium, Ag—Silver, Ca—Calcium, Sn—Tin, and Re—Rhenium, Cu—Copper. In some embodiments, the expandable metal alloy can be alloyed with a dopant that promotes corrosion, such as Ni—Nickel, Fe—Iron, Cu—Copper, Co—Cobalt, Ir—Iridium, Au—Gold, C—Carbon, Ga—Gallium, In—Indium, Mg—Mercury, Bi—Bismuth, Sn—Tin, and Pd—Palladium. The expandable metal alloy can be constructed in a solid solution process where the elements are combined with molten metal or metal alloy. Alternatively, the expandable metal alloy could be constructed with a powder metallurgy process. The expandable metal can be cast, forged, extruded, sintered, welded, mill machined, lathe machined, stamped, eroded or a combination thereof.

Optionally, non-expanding components may be added to the starting metallic materials. For example, ceramic, elastomer, plastic, epoxy, glass, or non-reacting metal components can be embedded in the expandable metal or coated on the surface of the expandable metal. Alternatively, the starting expandable metal may be the metal oxide. For example, calcium oxide (CaO) with water will produce calcium hydroxide in an energetic reaction. Due to the higher density of calcium oxide, this can have a 260% volumetric expansion (e.g., converting 1 mole of CaO may cause the volume to increase from 9.5 cc to 34.4 cc). In one variation, the expandable metal is formed in a serpentinite reaction, a hydration and metamorphic reaction. In one variation, the resultant material resembles a mafic material. Additional ions can be added to the reaction, including silicate, sulfate, aluminate, carbonate, and phosphate. The metal can be alloyed to increase the reactivity or to control the formation of oxides.

The expandable metal can be configured in many different fashions, as long as an adequate volume of material is available for fully expanding. For example, the expandable metal may be formed into a single long member, multiple short members, rings, among others. In another embodiment, the expandable metal may be formed into a long wire of expandable metal, that can be in turn be wound around a downhole feature such as a mandrel. In certain other embodiments, the expandable metal is a collection of individual separate chunks of the metal held together with a binding agent. In yet other embodiments, the expandable metal is a collection of individual separate chunks of the metal that are not held together with a binding agent. Additionally, a delay coating may be applied to one or more portions of the expandable metal to delay the expanding reactions.

Figure 2:
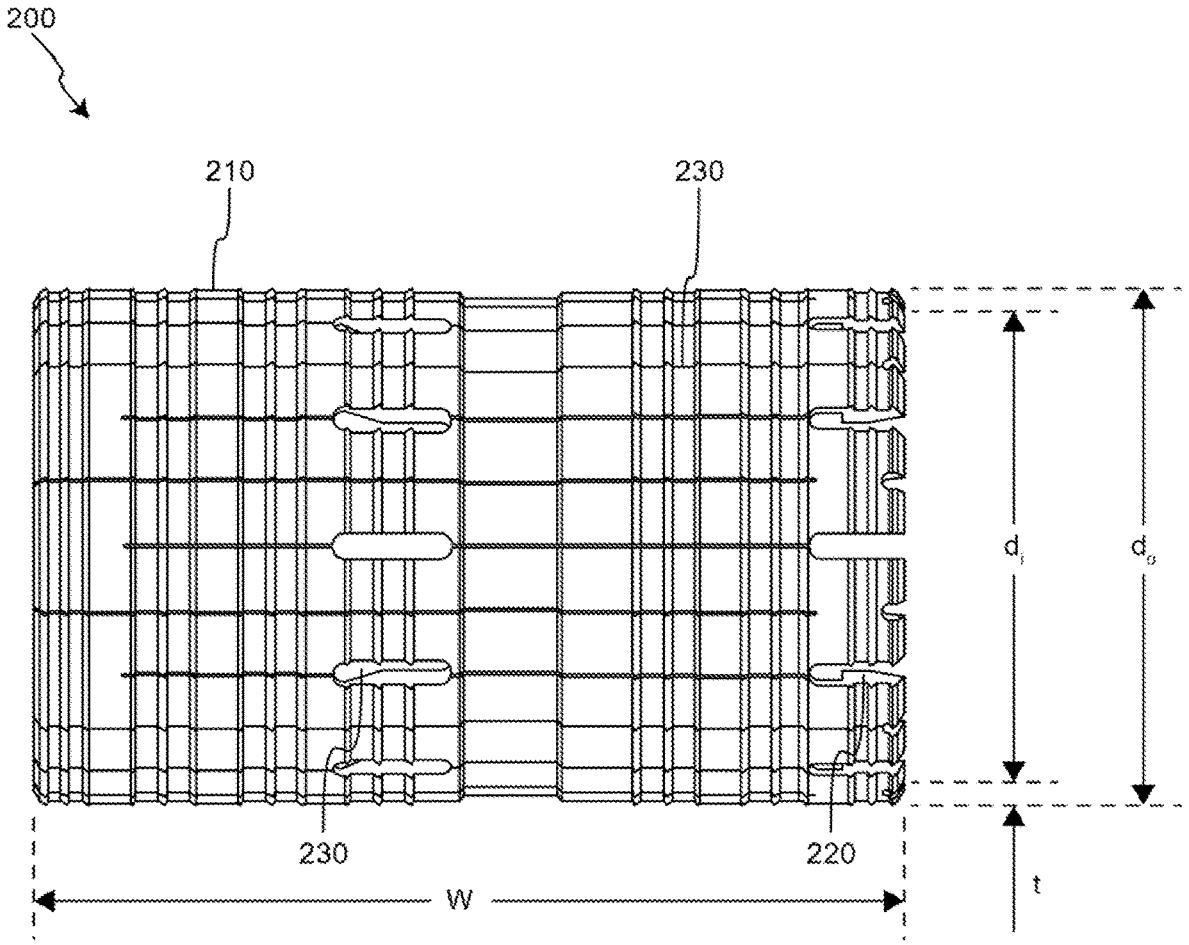
FIG. 2 illustrates one embodiment of a slip ring designed, manufactured and operated according to one embodiment of the disclosure.

Turning to FIG. 2, illustrated is one embodiment of a slip ring 200 designed, manufactured and operated according to one embodiment of the disclosure. The slip ring 200, in the illustrated embodiment, includes an expandable metal ring member 210 having a width (w), a wall thickness (t), an inside diameter ($d_i$) and an outside diameter ($d_o$), and comprising a metal configured to expand in response to hydrolysis, as described above. In at least one embodiment, the width (w) is no greater than 2.75 meters (e.g., about 9 feet). In at least one other embodiment, the width (w) is no greater than 1.83 meters (e.g., about 6 feet). In yet at least another embodiment, the width (w) ranges from 0.3 meters (e.g., about 1 foot) to 1.2 meters (e.g., about 4 feet). In at least one embodiment, the thickness (t) is no greater than 15 centimeters (e.g., about 5.9 inches). In at least one other embodiment, the thickness (t) is no greater than 9 centimeters (e.g., about 3.5 inches). In yet at least another embodiment, the thickness (t) ranges from 15 centimeters (e.g., about 5.9 inches) to 6 centimeters (e.g., about 2.4 inches).

In at least the embodiment of FIG. 2, the expandable metal ring member 210 of FIG. 2 is a barrel slip structure. For example, the barrel slip structure may include angled surfaces 220 positioned along its inside diameter ($d_1$). In at least the embodiment of FIG. 2, the angled surfaces 220 are configured to engage one or more associated wedges of a sealing assembly, for example to move the expandable metal ring 210 between a radially reduced state (e.g., as shown) and a radially enlarged state.

The slip ring 200 of FIG. 2 additionally includes one or more cuts 230 located in the wall thickness (t) and spaced around a circumference of the expandable metal ring member 210. In one or more embodiments, the one or more cuts 230 allow the expandable metal ring member 210 to move between the radially reduced state and the radially enlarged state. In the illustrated embodiment, the one or more cuts 230 are a plurality of axial cuts located in the wall thickness (t). The phrase "axial cuts," as used herein, means that the largest diameter of the one or more cuts 230 are generally aligned with a central axis of the slip ring 200, as opposed to generally perpendicular with the central axis of the slip ring 200. Further to the embodiment of FIG. 2, one or more of the one or more cuts 230 extend entirely through the wall thickness (t). In certain other embodiments, however, the one or more cuts 230 begin from the inside diameter ($d_i$), but do not extend entirely through the wall thickness (t), or the one or more cuts 230 begin from the outside diameter ($d_o$), but do not extend entirely through the wall thickness (t).

Figure 3:
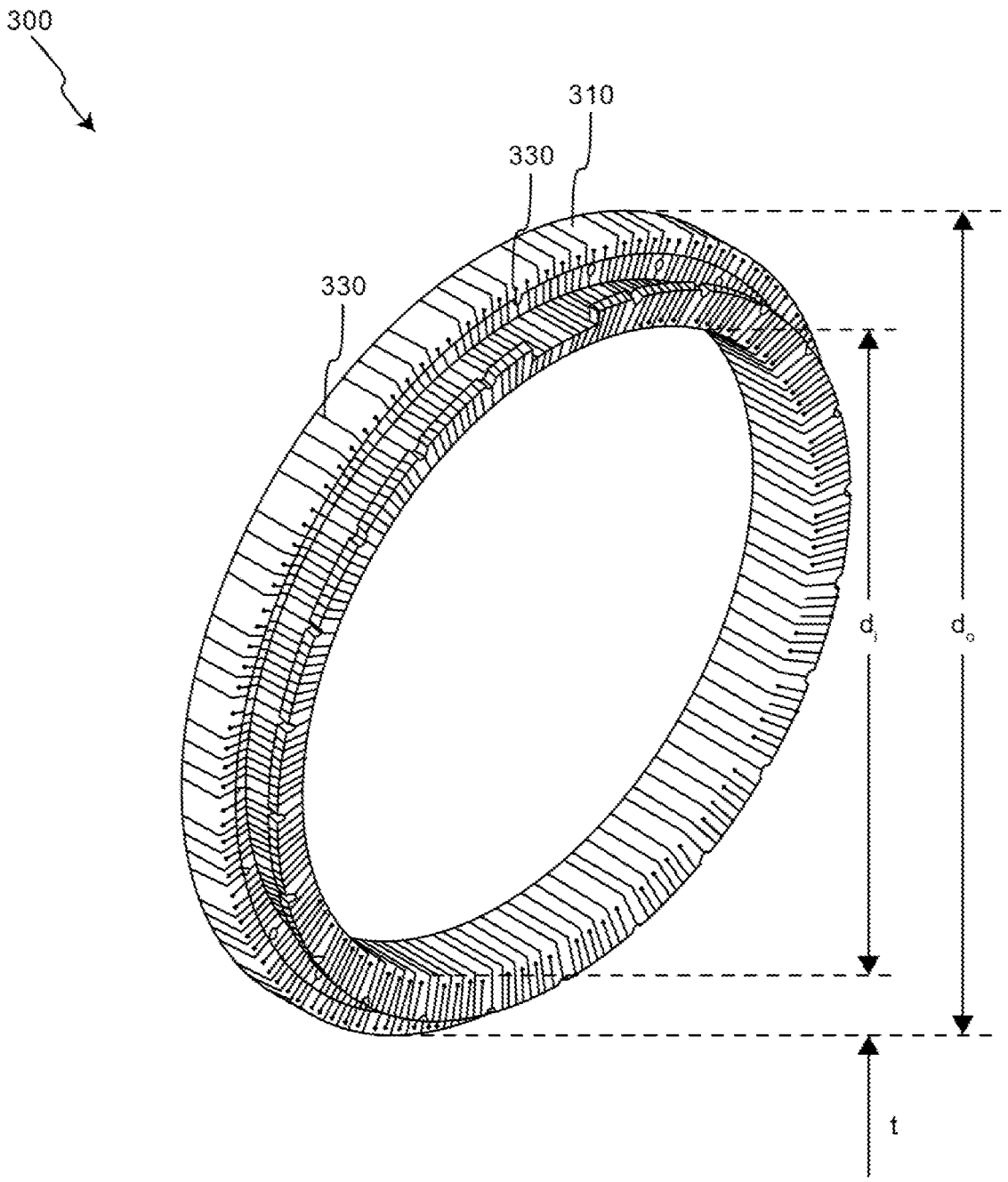
FIG. 3 illustrates one embodiment of a slip ring designed, manufactured and operated according to an alternative embodiment of the disclosure.

Turning to FIG. 3, illustrated is one embodiment of a slip ring 300 designed, manufactured and operated according to an alternative embodiment of the disclosure. The slip ring 300 is similar in certain respects to the slip ring 200. Accordingly, like reference identifiers have been used to indicate similar, if not identical, features. The slip ring 300 differs, for the most part, from the slip ring 200, in that the slip ring 300 employs a beam spring structure as its expandable metal ring member 310. Further to the embodiment of FIG. 3, one or more of the one or more cuts 330 extend entirely through the width (w). The one or more cuts 330 of the embodiment of FIG. 3, like the one or more cuts 230, are axial cuts located in the wall thickness (t).

Figure 4:
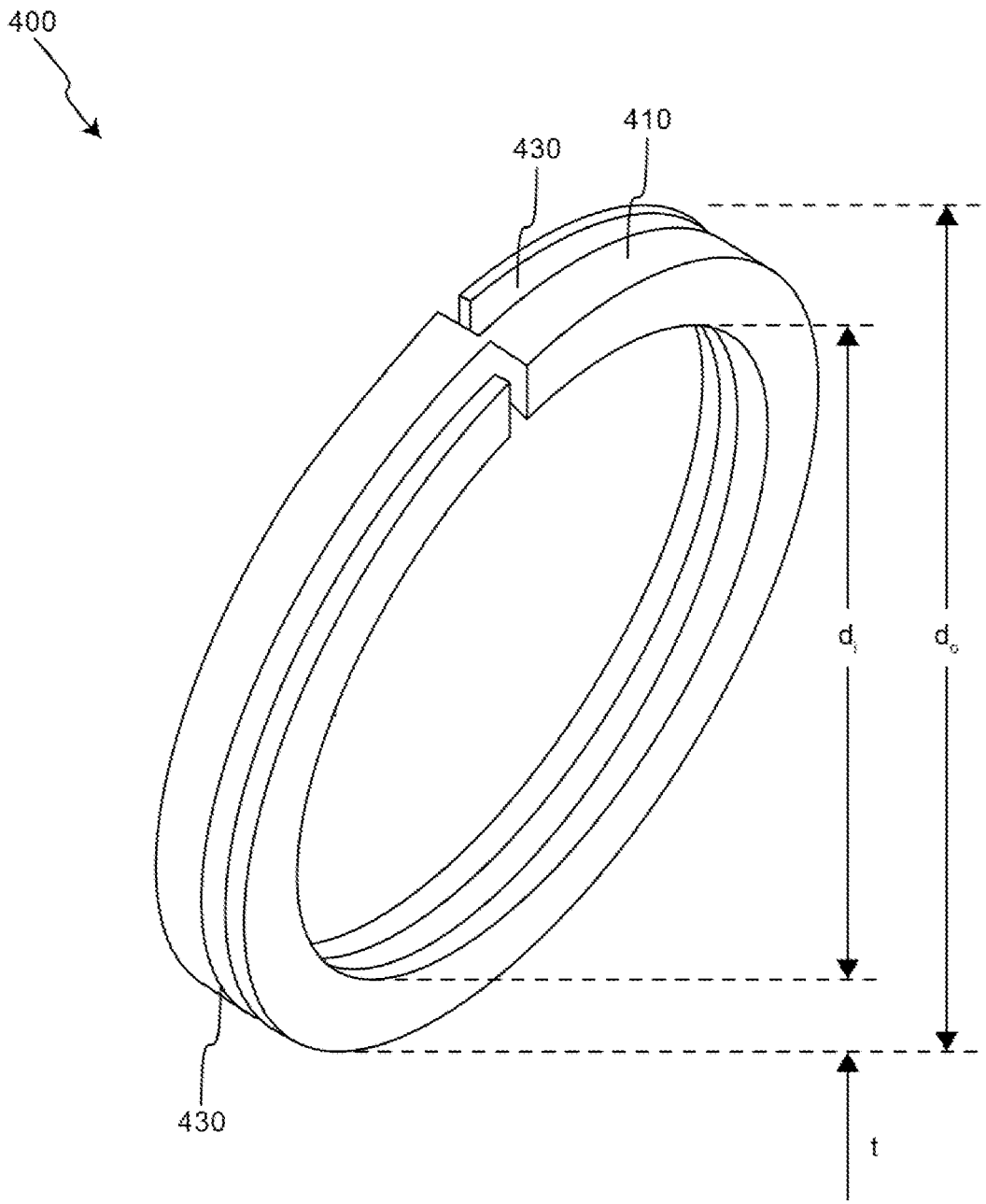
FIG. 4 illustrates one embodiment of a slip ring designed, manufactured and operated according to an alternative embodiment of the disclosure.

Turning to FIG. 4, illustrated is one embodiment of a slip ring 400 designed, manufactured and operated according to an alternative embodiment of the disclosure. The slip ring 400 is similar in certain respects to the slip ring 300. Accordingly, like reference identifiers have been used to indicate similar, if not identical, features. The slip ring 400 differs, for the most part, from the slip ring 300, in that the slip ring 400 employs a spiral split ring structure as its expandable metal ring member 410. Further, in the illustrated embodiment of FIG. 4, the one or more cuts 430 are one or more circumferential cuts. Further to the embodiment of FIG. 4, the one or more cuts 430 extend entirely through the wall thickness (t).

Figure 5A:
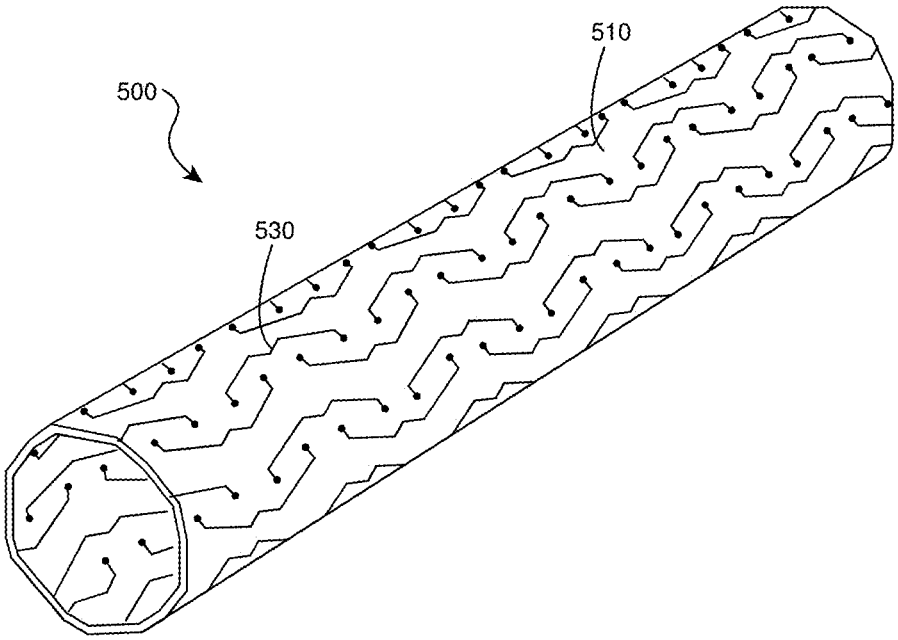
FIGS. 5A and 5B illustrate alternative views of one embodiment of a slip ring designed, manufactured and operated according to an alternative embodiment of the disclosure.
Figure 5B:
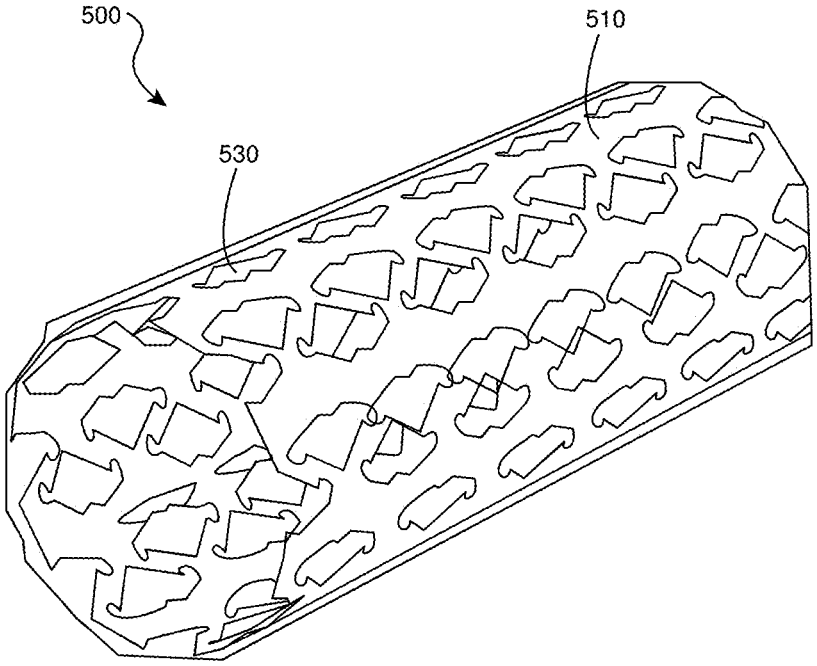

Turning to FIGS. 5A and 5B, illustrated are alternative views of one embodiment of a slip ring 500 designed, manufactured and operated according to an alternative embodiment of the disclosure. Specifically, FIG. 5A illustrates the slip ring 500 in a radially reduced state, and FIG. 5B illustrates the slip ring 500 in a radially enlarged state. The slip ring 500 is similar in certain respects to the slip ring 200. Accordingly, like reference identifiers have been used to indicate similar, if not identical, features. The slip ring 500 differs, for the most part, from the slip ring 200, in that the slip ring 500 employs a biflex structure as its expandable metal ring member 510. Further to the embodiment of FIG. 5, the one or more cuts 530 are geometric shapes. The phrase "geometric shapes", as used herein, means a figure or area closed by a boundary which is created by combining a specific amount of curves, points and lines. In the illustrated embodiment of FIGS. 5A and 5B, the one or more cuts 530 are spaced-apart around a circumference of the expandable metal ring member 510. Furthermore, adjacent ones of the one or more cuts 530 are rotated from one another by about 180 degrees.

Figure 6A:
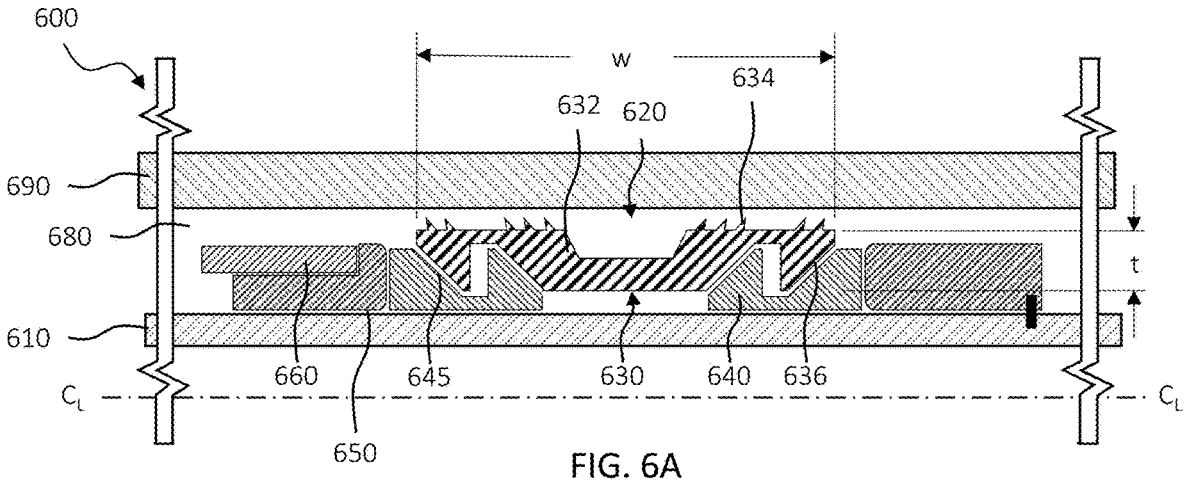
FIGS. 6A through 6C illustrate various different deployment states for a sealing assembly designed, manufactured and operated according to an embodiment of the disclosure.
Figure 6B:
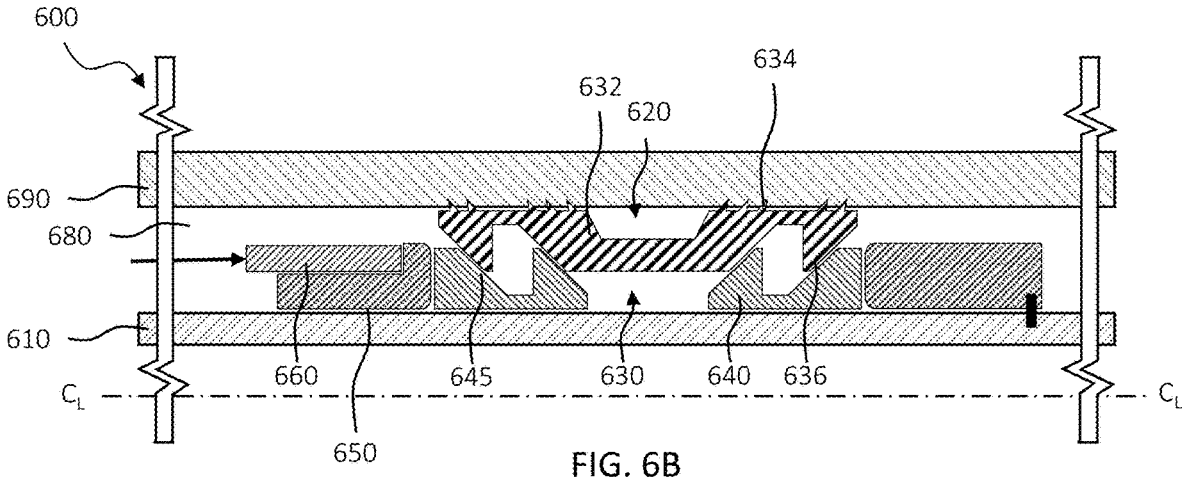
Figure 6C:
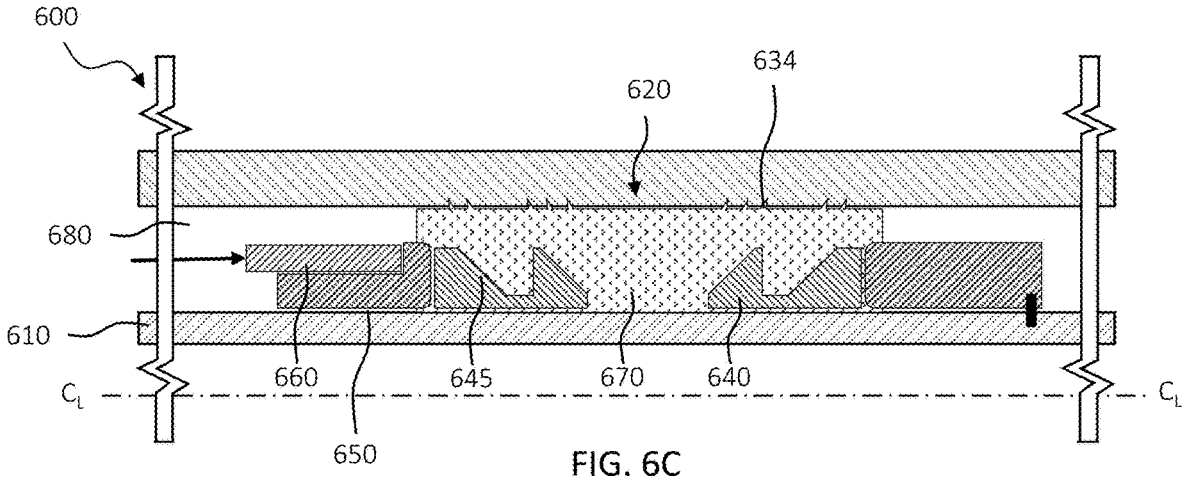

Turning now to FIGS. 6A through 6C, illustrated are various different deployment states for a sealing tool 600 designed, manufactured and operated according to one aspect of the disclosure. FIG. 6A illustrates the sealing tool 600 in a run-in-hole state, and thus its slip ring is in the radially reduced state, and furthermore the expandable metal ring member has not been subjected to reactive fluid to begin hydrolysis. In contrast, FIG. 6B illustrates the sealing tool 600 with its slip ring in the radially enlarged state, but again the expandable metal ring member has not been subjected to reactive fluid to begin hydrolysis. In contrast, FIG. 6C illustrates the sealing tool 600 with its radially enlarged slip ring having been subjected to reactive fluid, and thus starting the hydrolysis reaction, thereby forming an expanded metal ring member (e.g., the expandable metal ring member post-expansion). As disclosed above, the expandable metal may be subjected to a suitable reactive fluid within the wellbore, thereby forming the expanded metal ring member.

The sealing tool 600, in the illustrated embodiment of FIGS. 6A through 6C, includes a mandrel 610. The mandrel 610, in the illustrated embodiment, is centered about a centerline ($C_L$). The sealing tool 600, in at least the embodiment of FIGS. 6A through 6C, additionally includes a bore 690 positioned around the mandrel 610. The bore 690, in at least one embodiment, is exposed wellbore. The bore 690, in at least one other embodiment, is a tubular positioned within a wellbore, such as a casing, production tubing, etc. In accordance with one aspect of the disclosure, the mandrel 610 and the bore 690 form an annulus 680.

In accordance with one embodiment of the disclosure, the sealing tool 600 includes a sealing assembly 620 positioned about the mandrel 610. In at least one embodiment, the sealing assembly 620 includes a slip ring 630. The slip ring 630, as discussed above, may include an expandable metal ring member 632 having a width (w), a wall thickness (t), an inside diameter ($d_i$) and an outside diameter ($d_o$), and further more may comprise a metal configured to expand in response to hydrolysis.

The slip ring 630 may additionally include one or more cuts (not shown) (e.g., axial cuts extending entirely through the wall thickness (t)) located in the wall thickness (t) and spaced around a circumference of the expandable metal ring member 632. The one or more of cuts, in at least one embodiment, are configured to allow the expandable metal ring member 632 to move between a radially reduced state and a radially enlarged state. In the illustrated embodiment, the slip ring 630 additionally includes a roughened surface 634 along its outside diameter ($d_o$), for example to help the slip ring 630 firmly engage the bore 690 when it is in the radially enlarged state. The roughened surface 634 may comprise many different features and remain within the scope of the present disclosure. Nevertheless, in the embodiment of FIGS. 6A through 6C, the roughened surface 634 is a plurality of protrusions, such as a plurality of teeth.

The slip ring 630 illustrated in FIGS. 6A through 6C is configured as a barrel slip structure, for example similar to that illustrated in FIG. 2. In the illustrated embodiment of FIGS. 6A through 6C, the slip ring 630 additionally includes angled surfaces 636 positioned along its inside diameter ($d_i$). As will be detailed below, the angled surfaces 636 are configured to engage one or more associated wedges to move the expandable metal ring member 632 between the radially reduced state and a radially enlarged state. Nevertheless, the barrel slip structure could employ different designs while remaining with the scope of the present disclosure.

The sealing assembly 620, in the illustrated embodiment, additionally includes the one or more associated wedges 640. The one or more associated wedges 640, in the illustrated embodiment, include one or more associated angled surfaces 645. As is evident in the embodiment of FIGS. 6A through 6C, the one or more associated angled surface 645 are operable to engage with the opposing angled surfaces 636 of the slip ring 630, and thus move the expandable metal ring member 632 between the radially reduced state (e.g., as shown in FIG. 6A) and a radially enlarged state (e.g., as shown in FIGS. 6B and 6C).

The sealing assembly 620, in the illustrated embodiment, may additionally include one or more end rings 650 located on opposing sides of the one or more associated wedges 640. In the illustrated embodiment, one of the end rings 650 may be axially fixed relative to the mandrel 610 or the bore 690, and the other of the end rings 650 is allowed to axially move relative to the mandrel 610 or the bore 690, and thus move the expandable metal ring member 632 between the radially reduced state (e.g., as shown in FIG. 6A) and a radially enlarged state (e.g., as shown in FIGS. 6B and 6C).

The seal assembly 620, in one or more embodiments, additionally includes a piston structure 660 for axially moving the free end ring 650. Accordingly, the piston structure 660 may be used to move the expandable metal ring member 632 between the radially reduced state (e.g., as shown in FIG. 6A) and a radially enlarged state (e.g., as shown in FIGS. 6B and 6C). The piston structure 660 may take on many different designs while remaining within the scope of the present disclosure.

With reference to FIG. 6A, the expandable metal ring member 632 is again configured as the barrel slip structure comprises a metal configured to expand in response to hydrolysis. The expandable metal ring member 632 may comprise any of the expandable metals discussed above. The expandable metal ring member 632 may have a variety of different shapes, sizes, etc. and remain within the scope of the disclosure.

With reference to FIG. 6B, illustrated is the sealing tool 600 of FIG. 6A after setting the slip ring 630. In the illustrated embodiment of FIG. 6B, the slip ring 630 is set by axially moving (e.g., by way of the piston 660) the end rings 650 relative to one another and thereby engaging the one or more associated angled surface 645 of the one or more wedges 640 with the opposing angled surfaces 636 of the slip ring 630. Accordingly, the expandable metal ring member 632 is moved between the radially reduced state (e.g., as shown in FIG. 6A) and the radially enlarged state shown in FIG. 6B. In the illustrated embodiment of FIG. 6B, the expandable metal ring member 632 engages with the bore 690, thereby spanning the annulus 680. Further to the embodiment of FIG. 6B, the expandable metal ring member 632 has been mechanically and/or elastically deformed, and in certain embodiments also plastically deformed to engage the bore 690.

With reference to FIG. 6C, illustrated is the sealing tool 600 of FIG. 6B after subjecting the expandable metal ring member 632 to reactive fluid to form an expanded metal ring member 670, as discussed above. As disclosed above, the expanded metal ring member 670 may include residual unreacted metal. The reactive fluid may be any of the reactive fluid discussed above. In the illustrated embodiment of FIG. 6C, the expanded metal ring member 670 at least partially fills the annulus 680, and thereby act as an anchor. It should be noted, that as the expanded metal ring member 670 remains in the radially enlarged state regardless of the force from the piston structure 660, certain embodiments may remove the force from the piston structure 660 after the expanded metal ring member 670 has been formed. The expanded metal ring member 670 may additionally have a sealing affect, and thus act as a secondary seal.

In certain embodiments, the time period for the hydration of the expandable metal ring member 632 is different from the time period for setting expandable metal ring member 632. For example, the setting of the expandable metal ring member 632 might create a quick, but weaker, anchor for the sealing assembly 620, whereas the expandable metal ring member 632 could take multiple hours to several days for the hydrolysis process to fully expand, but provide a strong anchor for the sealing assembly 620.

While not shown, the sealing tool 600, and more particularly the sealing assembly 620 of the sealing tool 600, may additionally include one or more sealing elements. For example, the one or more sealing elements could be located uphole or downhole of the slip ring 630, and thus be used to fluidly seal the annulus 680. In many situations, the one or more sealing elements comprise elastomeric sealing elements that are located downhole of the slip ring 630.

Figure 7A:
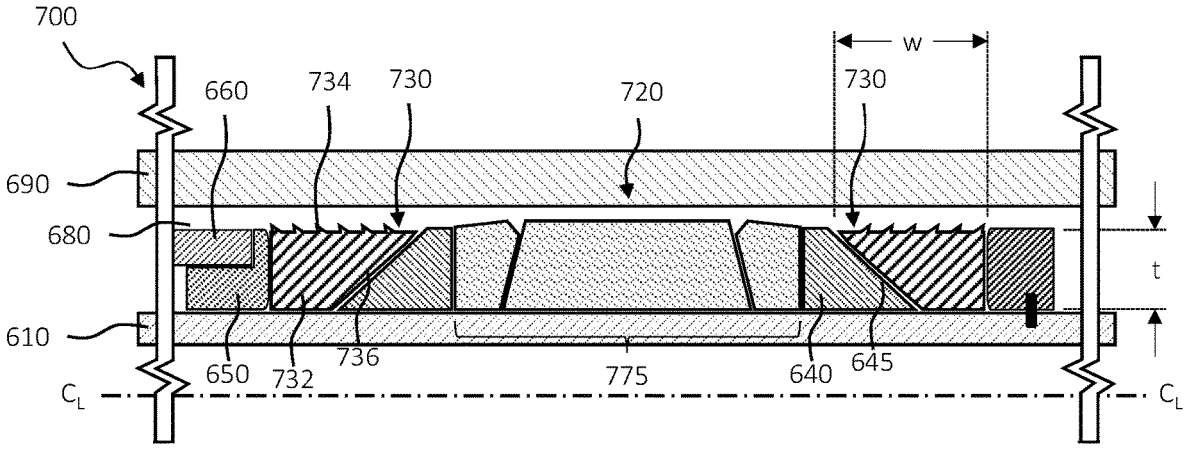
FIGS. 7A through 7C illustrate various different deployment states for a sealing assembly designed, manufactured and operated according to an alternative embodiment of the disclosure.
Figure 7B:
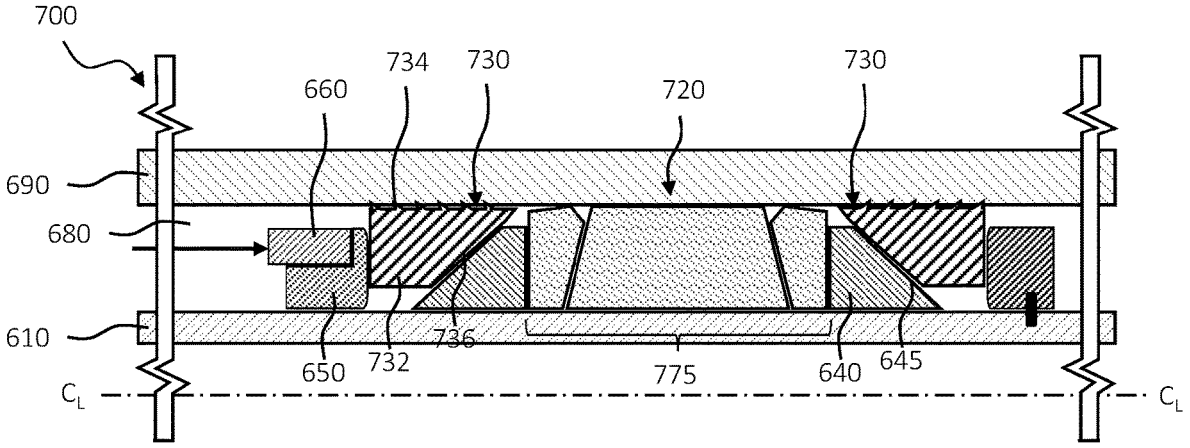
Figure 7C:
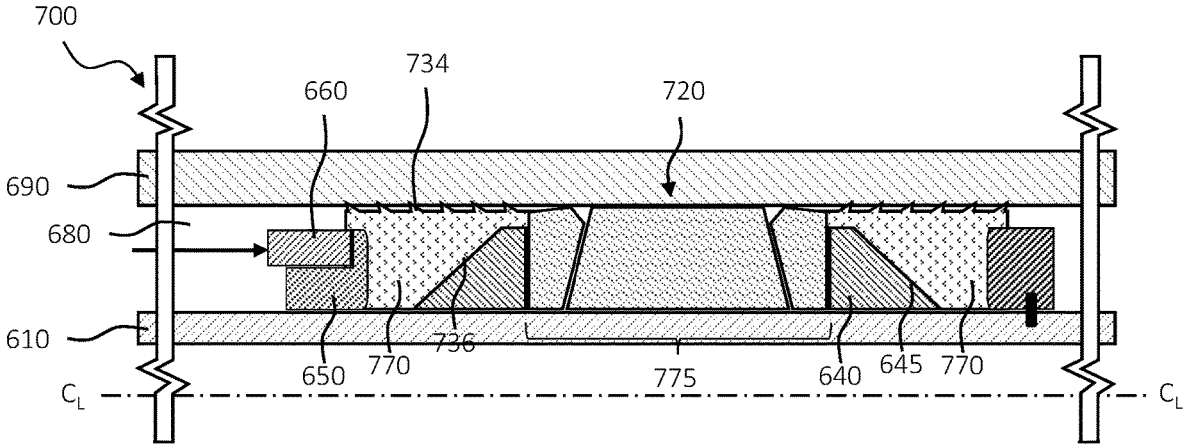

Turning to FIGS. 7A through 7C, depicted are various different deployment states for a sealing assembly 700 designed, manufactured and operated according to an alternative embodiment of the disclosure. FIG. 7A illustrates the sealing tool 700 in a run-in-hole state, and thus its slip ring is in the radially reduced state, and furthermore the expandable metal ring member(s) has not been subjected to reactive fluid to begin hydrolysis. In contrast, FIG. 7B illustrates the sealing tool 700 with its slip ring in the radially enlarged state, but again the expandable metal ring member(s) has not been subjected to reactive fluid to begin hydrolysis. In contrast, FIG. 7C illustrates the sealing tool 700 with its radially enlarged slip ring having been subjected to reactive fluid, and thus starting the hydrolysis reaction, to form an expanded metal ring members (e.g., the expandable metal ring members post-expansion).

The sealing tool 700 is similar in certain respects to the sealing tool 600. Accordingly, like reference numbers have been used to indicate similar, if not identical, features. The sealing tool 700 differs, for the most part, from the sealing tool 600, in that the sealing tool 700 employs a pair of slip rings 730 straddling one or more sealing elements 775. In at least one embodiment, each of the pair of slip rings 730 may include the expandable metal ring member 732, the one or more cuts (not shown), and the roughened surface 734, in one or more embodiments. In the embodiment of FIGS. 7A through 7C, each of the expandable metal ring members 732 is configured as a beam spring structure, such as shown in FIG. 3 above.

Further to the embodiment of FIGS. 7A through 7C, the sealing assembly 720 additionally includes the one or more sealing elements 775 positioned about the mandrel. The one or more sealing elements 775 are operable to move between a radially relaxed state, such as that shown in FIG. 7A, and a radially expanded state, such as that shown in FIGS. 7B and 7C. While three sealing elements 775 are illustrated in FIGS. 7A through 7C, other embodiments exist wherein only a single sealing element is employed. In the embodiment of FIGS. 7A through 7C, the one or more sealing elements 220 comprise one or more elastomeric sealing elements. For example, the one or more elastomeric sealing elements might comprise a non-swellable elastomer in one embodiment. Nevertheless, other embodiments exist wherein the one or more elastomeric sealing elements comprise a swellable elastomer.

With reference to FIG. 7A, each of the expandable metal ring members 732 is configured as a beam spring structure that comprise a metal configured to expand in response to hydrolysis. The expandable metal ring members 732 may comprise any of the expandable metals discussed above. The expandable metal ring members 732 may have a variety of different shapes, sizes, etc. and remain within the scope of the disclosure.

With reference to FIG. 7B, illustrated is the sealing tool 700 of FIG. 7A after setting the slip rings 730 and setting the one or more sealing elements 775. In the illustrated embodiment of FIG. 7B, the slip rings 730 and the one or more sealing elements 775 are set by axially moving (e.g., by way of the piston 660) the end rings 650 relative to one another and thereby engaging the one or more associated angled surface 645 of the one or more wedges 640 with the opposing angled surfaces 736 of the slip ring 730. Accordingly, the expandable metal ring member 732 is moved between the radially reduced state (e.g., as shown in FIG. 7A) and the radially enlarged state shown in FIG. 7B. Similarly, the one or more sealing elements 775 are moved between the radially relaxed state (e.g., as shown in FIG. 7A) and the radially expanded state shown in FIGS. 7B and 7C. In the illustrated embodiment of FIG. 7B, the expandable metal ring member 732 engages with the bore 690, thereby spanning the annulus 680. Further to the embodiment of FIG. 7B, the expandable metal ring member 732 has been mechanically and/or elastically deformed, and in certain embodiments plastically deformed to engage the bore 690. Additionally, in the illustrated embodiment of FIG. 7B, the one or more sealing elements 775 also engage with the bore 790, thereby sealing the annulus 780.

With reference to FIG. 7C, illustrated is the sealing tool 700 of FIG. 7B after subjecting the expandable metal ring members 732 to reactive fluid to form expanded metal ring members 770. As disclosed above, the expanded metal ring members 770 may include residual unreacted metal. The reactive fluid may be any of the reactive fluid discussed above. In the illustrated embodiment of FIG. 7C, the expanded metal ring members 770 at least partially fill the annulus 680, and thereby act as an anchor. The expanded metal ring members 770 may additionally have a sealing affect, and thus act as a secondary seal to the one or more sealing elements 775.

Aspects disclosed herein include:

A. A slip ring for use with a sealing assembly, the slip ring including: 1) an expandable metal ring member having a width (w), a wall thickness (t), an inside diameter ($d_i$) and an outside diameter ($d_o$), the expandable metal ring member comprising a metal configured to expand in response to hydrolysis; and 2) one or more cuts located in the wall thickness (t) and spaced around a circumference of the expandable metal ring member, the one or more cuts configured to allow the expandable metal ring member to move between a radially reduced state and a radially enlarged state.

B. A sealing tool, the sealing tool including: 1) a mandrel; and 2) a sealing assembly positioned about the mandrel, the sealing assembly having a slip ring including: a) an expandable metal ring member having a width (w), a wall thickness (t), an inside diameter ($d_i$) and an outside diameter ($d_o$), the expandable metal ring member comprising a metal configured to expand in response to hydrolysis; and b) one or more cuts located in the wall thickness (t) and spaced around a circumference of the expandable metal ring member, the one or more cuts configured to allow the expandable metal ring member to move between a radially reduced state and a radially enlarged state.

C. A method for sealing an annulus within a wellbore, the method including: 1) providing a sealing tool within a wellbore, the sealing tool including: a) a mandrel; and b) a sealing assembly positioned about the mandrel, the sealing assembly having a slip ring including: i) an expandable metal ring member having a width (w), a wall thickness (t), an inside diameter ($d_i$) and an outside diameter ($d_o$), the expandable metal ring member comprising a metal configured to expand in response to hydrolysis; and ii) a one or more cuts located in the wall thickness (t) and spaced around a circumference of the expandable metal ring member, the one or more cuts configured to allow the expandable metal ring member to move between a radially reduced state and a radially enlarged state; 2) setting the slip ring by moving the expandable metal ring member from the radially reduced state to the radially enlarged state; and 3) subjecting the expandable metal ring member in the radially enlarged stated to reactive fluid to form an expanded metal ring member.

Aspects A, B, and C may have one or more of the following additional elements in combination: Element 1: wherein the one or more cuts are a plurality of axial cuts located in the wall thickness (t). Element 2: wherein the expandable metal ring member is a barrel slip structure having angled surfaces positioned along its inside diameter ($d_i$), the angled surfaces configured to engage one or more associated wedges to move the expandable metal ring member between the radially reduced state and a radially enlarged state. Element 3: wherein one or more of the one or more cuts extend entirely through the wall thickness (t). Element 4: wherein the expandable metal ring member is a beam spring structure. Element 5: wherein one or more of the one or more cuts extend entirely through the width (w). Element 6: wherein the expandable metal ring member is a biflex structure, and further wherein one or more of the one or more cuts are geometric shapes. Element 7: wherein the expandable metal ring member is a spiral split ring, and further wherein the one or more cuts are a plurality of circumferential cuts. Element 8: wherein the width (w) is no greater than 2.75 meters. Element 9: wherein the width (w) ranges from 0.3 meters to 1.2 meters. Element 10: wherein the sealing assembly further includes one or more sealing elements positioned about the mandrel, the one or more sealing elements operable to move between a radially relaxed state and a radially expanded state. Element 11: wherein the one or more sealing elements are one or more elastomeric sealing elements. Element 12: wherein the sealing assembly further includes one or more wedges positioned about the mandrel, the one or more wedges operable to move the expandable metal ring member between the radially reduced state and a radially enlarged state. Element 13: wherein the expandable metal ring member is a barrel slip structure having angled surfaces positioned along its inside diameter ($d_i$), the angled surfaces configured to engage the one or more wedges to move the barrel slip structure between the radially reduced state and a radially enlarged state. Element 14: wherein the expandable metal ring member is a beam spring structure, and further wherein one or more of the one or more cuts extend entirely through the width (w). Element 15: wherein the expandable metal ring member is a biflex structure, and further wherein one or more of the one or more cuts are geometric shapes. Element 16: wherein the expandable metal ring member is a spiral split ring, and further wherein the one or more cuts are a plurality of circumferential cuts. Element 17: wherein the width (w) is no greater than 2.75 meters.

Those skilled in the art to which this application relates will appreciate that other and further additions, deletions, substitutions and modifications may be made to the described embodiments.

What is claimed is:

1. A slip ring for use with a sealing assembly, comprising:

an expandable metal ring member having a width (w), a wall thickness (t), an inside diameter ($d_i$) and an outside diameter ($d_o$), the expandable metal ring member comprising a single unitary piece of metal configured to expand in response to hydrolysis; and one or more cutouts of material located in the wall thickness (t) and spaced around a circumference of the expandable metal ring member, the one or more cutouts of material configured to allow the expandable metal ring member to move between a radially reduced state and a radially enlarged state, wherein the one or more cutouts of material are a plurality of axial cutouts of material located in the wall thickness (t), and further wherein the expandable metal ring member is a barrel slip structure having angled surfaces positioned along its inside diameter (di), the angled surfaces configured to engage one or more associated wedges to move the expandable metal ring member between the radially reduced state and the radially enlarged state.

2. The slip ring as recited in claim 1, wherein one or more of the one or more cutouts of material extend entirely through the wall thickness (t).

3. The slip ring as recited in claim 1, wherein the width (w) is no greater than 2.75 meters.

4. The slip ring as recited in claim 1, wherein the width (w) ranges from 0.3 meters to 1.2 meters.

5. A sealing tool, comprising:

a mandrel; and a sealing assembly positioned about the mandrel, the sealing assembly having a slip ring including:

an expandable metal ring member having a width (w), a wall thickness (t), an inside diameter ($d_i$) and an outside diameter ($d_o$), the expandable metal ring member comprising a single unitary piece of metal configured to expand in response to hydrolysis; and one or more cutouts of material located in the wall thickness (t) and spaced around a circumference of the expandable metal ring member, the one or more cutouts of material configured to allow the expandable metal ring member to move between a radially reduced state and a radially enlarged state, wherein the sealing assembly further includes one or more wedges positioned about the mandrel, the one or more wedges operable to move the expandable metal ring member between the radially reduced state and the radially enlarged state.

6. The sealing tool as recited in claim 5, wherein the sealing assembly further includes one or more sealing elements positioned about the mandrel, the one or more sealing elements operable to move between the radially reduced state and the radially enlarged state.

7. The sealing tool as recited in claim 6, wherein the one or more sealing elements are one or more elastomeric sealing elements.

8. The sealing tool as recited in claim 5, wherein the expandable metal ring member is a barrel slip structure having angled surfaces positioned along its inside diameter ($d_i$), the angled surfaces configured to engage the one or more wedges to move the barrel slip structure between the radially reduced state and the radially enlarged state.

9. The sealing tool as recited in claim 5, wherein the expandable metal ring member is a beam spring structure, and further wherein one or more of the one or more cutouts of material extend entirely through the width (w).

10. The sealing tool as recited in claim 5, wherein the expandable metal ring member is a biflex structure, and further wherein one or more of the one or more cutouts of material are geometric shapes.

11. The sealing tool as recited in claim 5, wherein the expandable metal ring member is a spiral split ring, and further wherein the one or more cutouts of material are a plurality of circumferential cuts.

12. The sealing tool as recited in claim 5, wherein the width (w) is no greater than 2.75 meters.

13. A method for sealing an annulus within a wellbore, comprising:

providing a sealing tool within a wellbore, the sealing tool including:

a mandrel; and a sealing assembly positioned about the mandrel, the sealing assembly having a slip ring including:

an expandable metal ring member having a width (w), a wall thickness (t), an inside diameter ($d_i$) and an outside diameter ($d_o$), the expandable metal ring member comprising a single unitary piece of metal configured to expand in response to hydrolysis; and one or more cutouts of material located in the wall thickness (t) and spaced around a circumference of the expandable metal ring member, the one or more cutouts of material configured to allow the expandable metal ring member to move between a radially reduced state and a radially enlarged state;

setting the slip ring by moving the expandable metal ring member from the radially reduced state to the radially enlarged state; and subjecting the expandable metal ring member in the radially enlarged state to reactive fluid to form an expanded metal ring member.

14. A slip ring for use with a sealing assembly, comprising:

an expandable metal ring member having a width (w), a wall thickness (t), an inside diameter ($d_i$) and an outside diameter ($d_o$), the expandable metal ring member comprising a single unitary piece of metal configured to expand in response to hydrolysis; and one or more cutouts of material located in the wall thickness (t) and spaced around a circumference of the expandable metal ring member, the one or more cutouts of material configured to allow the expandable metal ring member to move between a radially reduced state and a radially enlarged state, wherein the expandable metal ring member is a spiral split ring, and further wherein the one or more cutouts of material are a plurality of circumferential cuts.

* * * * *